US010093510B2

(12) United States Patent
Fujita et al.

(10) Patent No.: US 10,093,510 B2
(45) Date of Patent: Oct. 9, 2018

(54) PAPER SHEET STORAGE BOX AND AUTOMATIC TELLER MACHINE

(71) Applicant: Hitachi-Omron Terminal Solutions, Corp., Shinagawa-ku, Tokyo (JP)

(72) Inventors: Junji Fujita, Tokyo (JP); Masayasu Ueno, Tokyo (JP)

(73) Assignee: HITACHI-OMRON TERMINAL SOLUTIONS, CORP., Tokyo (JP)

( * ) Notice: Subject to any disclaimer, the term of this patent is extended or adjusted under 35 U.S.C. 154(b) by 0 days.

(21) Appl. No.: 15/543,779

(22) PCT Filed: Mar. 22, 2016

(86) PCT No.: PCT/JP2016/058969

§ 371 (c)(1),
(2) Date: Jul. 14, 2017

(87) PCT Pub. No.: WO2016/194442

PCT Pub. Date: Dec. 8, 2016

(65) Prior Publication Data

US 2018/0082509 A1 Mar. 22, 2018

(30) Foreign Application Priority Data

Jun. 3, 2015 (JP) ..... 2015-113355

(51) Int. Cl.
*B65H 31/24* (2006.01)
*G07D 11/00* (2006.01)
*G07F 19/00* (2006.01)

(52) U.S. Cl.
CPC ..... *B65H 31/24* (2013.01); *G07D 11/0006* (2013.01); *G07D 11/0084* (2013.01); *G07F 19/202* (2013.01); *B65H 2402/44* (2013.01); *B65H 2402/45* (2013.01); *B65H 2405/115* (2013.01); *B65H 2405/332* (2013.01)

(58) Field of Classification Search
CPC ..... G07D 11/0084; G07D 11/006; G07F 19/202; B65H 31/24; B65H 2402/44; B65H 2402/45; B65H 2405/115; B65H 2405/332
See application file for complete search history.

(56) References Cited

U.S. PATENT DOCUMENTS 8,369,986 B2 * 2/2013 Doi ..... B65H 39/115 270/58.18
9,430,893 B1 * 8/2016 Blake ..... G07D 3/16
9,734,651 B1 * 8/2017 Ito ..... G07D 11/0084
(Continued)

FOREIGN PATENT DOCUMENTS

JP 2013-205940 A 10/2013

*Primary Examiner* — David H Bollinger
(74) *Attorney, Agent, or Firm* — Foley & Lardner LLP

(57) ABSTRACT

Provided is a paper sheet storage unit and an automatic teller machine with which storage space can be partitioned while maintaining operability with respect to paper currency. The paper sheet storage unit is equipped with: a partition member that partitions a storage space for paper sheets into multiple storage spaces, and has a recessed portion at a position where the paper sheets are removed; and a door that has a protruding portion for filling the recessed portion at a position corresponding to the recessed portion, and that opens/closes an opening that includes the multiple storage spaces.

5 Claims, 11 Drawing Sheets

(56) References Cited

U.S. PATENT DOCUMENTS

| | | | | |
|---|---|---|---|---|
| 2008/0128487 | A1* | 6/2008 | Graef | G06Q 20/1085 235/379 |
| 2012/0024659 | A1* | 2/2012 | Mizoro | G07D 11/0012 194/206 |
| 2014/0144749 | A1* | 5/2014 | Iwasaki | G07D 11/0081 194/206 |

* cited by examiner

PAPER SHEET STORAGE BOX AND AUTOMATIC TELLER MACHINE

TECHNICAL FIELD

The present invention relates to, for example, a paper sheet storage box mounted in a bill handling device such as incorporated in an ATM (Automatic Teller Machine) installed at financial facilities and the like, and to an automatic teller machine.

BACKGROUND ART

Conventionally, the bill handling machine is mounted in the automatic teller machine used in the financial facilities and the like. This bill handling device includes: a bill depositing and dispensing slot through which a user deposits or withdraws a bill or some bills; a bill determination portion which determines whether a bill is a deposited bill or a bill to be dispensed; a temporary storage box for temporarily storing the deposited bill(s) till the conclusion of a transaction; a bill storage box for receiving and storing the bill(s); and a bill conveyance passage for conveying the bill(s) to the above-described parts. The bill storage box includes: a recycle box which stores the bills deposited/dispensed by bill denomination; a loading box which replenishes the recycle box with the bills or collects the bills from the recycle box; a reject box which stores reject bills which are determined by the bill determination portion as falling short of the standards. The reject box is desirably composed of a plurality of chambers because the box may sometimes be adapted to store the reject bills as sorting them into a bill rejected at deposition/reception; a bill rejected at dispensation; a bill left by the customer; and the like. There may be a case where folded bills or crumpled bills are stored. Therefore, it is imperative to reliably sort out such bills before storage. The smaller in size, the better is the bill handling device. It is therefore desirable that the reject box is also downsized as much as possible.

CITATION LIST

Patent Literature

PTL 1: Japanese Patent Application Laid-Open No. 2013-205940

SUMMARY OF INVENTION

Technical Problem

The above patent literature 1 proposes an operation where the reject box is divided into plural box portions such that, for example, an upper reject box portion stores bogus bills while a lower reject box portion stores bills which do not include the bogus bills but those to be stored separately from acceptable bills. Such a reject box requires a partition plate for perfectly dividing the box into the upper and lower portions because the upper and lower portions must be reliably separated. On the other hand, this reject box has a problem that when the bills are extracted from the reject box, the partition plate interferes with a bill extraction operation, resulting in the decrease in bill extraction handleability.

In view of the above problems, the invention has an object to provide a paper sheet storage box which permits a storage space thereof to be partitioned while maintaining good bill handleability, and an automatic teller machine using the same.

Solution to Problem

According to an aspect of the invention for solving the above problems and achieving the above object, a paper sheet storage box includes: a partition member which partitions a paper sheet storage space into a plurality of storage spaces and includes a recess at a position for extraction of the paper sheets; and a door which includes a protrusion located at a position corresponding to the recess so as to close the recess, and serves to open or close an opening including the plurality of storage spaces.

Advantageous Effects of Invention

The invention permits the storage space to be partitioned while maintaining good bill handleability.

DESCRIPTION OF EMBODIMENTS

A paper sheet storage box and an automatic teller machine according to an embodiment of the invention will be described in detail with reference to the accompanying drawings.

Figure 1:
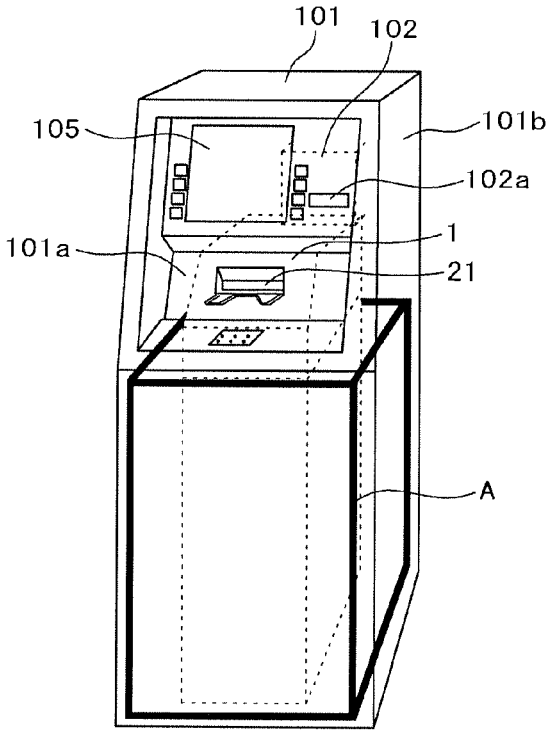
FIG. 1 is a perspective view showing an external appearance of an automatic teller machine.

FIG. 1 is a perspective view showing an external appearance of an automatic teller machine 101. As shown in FIG. 1, an automatic teller machine 101 includes a machine housing 101*b*. An upper part of the machine housing 101*b* contains therein: a customer operation portion 105 on the left side; and a card/statement processing mechanism 102 on the right side. The customer operation portion 105 displays the contents of transaction and accepts input. The card/statement processing mechanism 102 is communicated with a card slot 102*a* formed in an upper front panel 101*a* so as to process a card of a user and to output a printed account statement.

The upper front panel 101*a* of the automatic teller machine 101 is provided with a bill depositing/dispensing slot (bill slot) 21. The automatic teller machine 101 contains therein a bill handling device 1 for processing bills. The bill handling device 1 other than the bill depositing/dispensing slot is enclosed by a vault housing A which is independent from the machine housing 101*b* and is made of a thick iron plate having a thickness of tens of millimeters.

Figure 2:
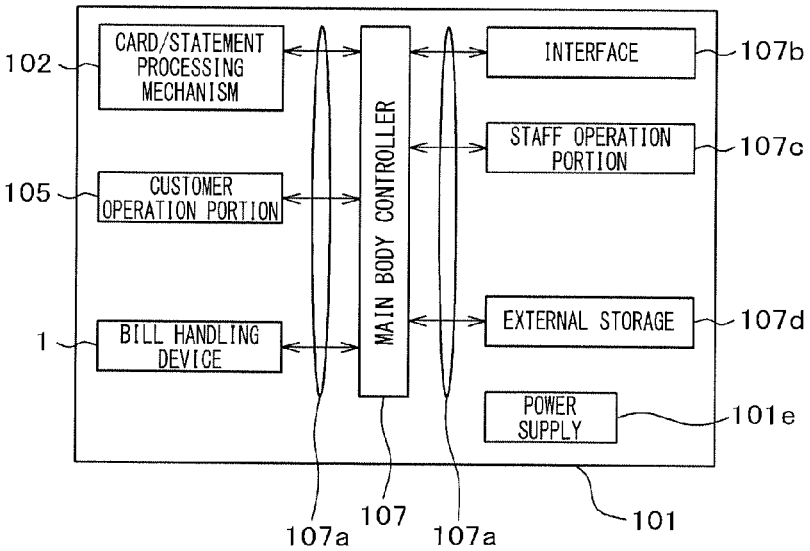
FIG. 2 is a block diagram showing control relations of the automatic teller machine.

FIG. 2 is a control block diagram showing control relations of the automatic teller machine 101. The card/statement processing mechanism 102, the bill handling device 1 and the customer operation portion 105 housed in the automatic teller machine 101 are connected to a main body controller 107 via a bus 107*a*, performing required operations under the control of the main body controller 107. In addition to the above components, the main body controller 107 is also connected with an interface 107*b*, a staff operation portion 107*c* and an external storage 107*d* via the bus 107*a*, sending or receiving required data. However, these components are not directly related to the features of the invention and hence, the detailed description thereof is dispensed with. A component 101*e* shown in FIG. 2 is a power supply for supplying an electric power to the above mechanism and components.

Figure 3:
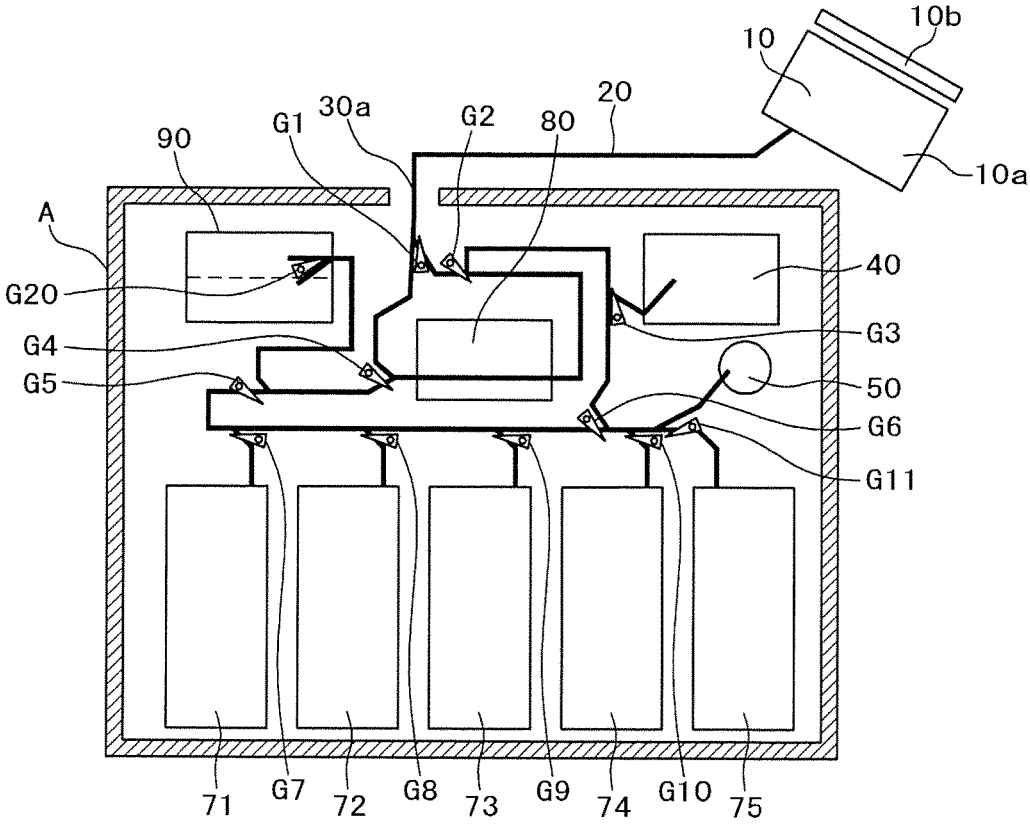
FIG. 3 is a schematic diagram showing a structure of bill conveyance passages.

FIG. 3 is a sectional view of the bill handling device 1. The bill handling device 1 includes: a bill depositing/dispensing slot 10; a conveyance passage 20; a conveyance passage 30; a determination portion 80; a temporary storage box 40; a return-bill temporary storage box 50; storage boxes 71 to 75; and a collection box 90. The bill depositing/dispensing slot 10 and the conveyance passage 20 are disposed on a top side of a vault A. The other components are disposed in the vault A. The bill depositing/dispensing slot 10 is provided to permit the user to deposit or withdraw some bills. The bill depositing/dispensing slot 10 includes a pocket 10*a* and a shutter 10*b*. The pocket 10*a* defines a space for the bill to be placed in a position inclined relative to the horizontal plane. The conveyance passage 20 and the conveyance passage 30 are for conveyance of the bills. The conveyance of the bills is performed by using known rollers (not shown) and the like. The determination portion 80 determines the denomination and the authenticity of the bill carried in both directions and decides whether to return or receive the deposited bill based on a determination result. The temporary storage box 40 temporarily stores bill(s) deposited by the user till the conclusion of a transaction. The return-bill temporary storage box 50 temporarily stores any bill, out of those deposited, that is determined to be unacceptable. The storage boxes 71 to 75 store the bills on a per-bill denomination basis. The storage box 74 or the storage box 75 may also be used as a storage box for storing bills to be deposited or bills to be dispensed. In this embodiment, the storage box 75 is used as the storage box for this purpose. The collection box 90 is used for collecting the bogus bills or storing the bills left by the user.

Figure 4:
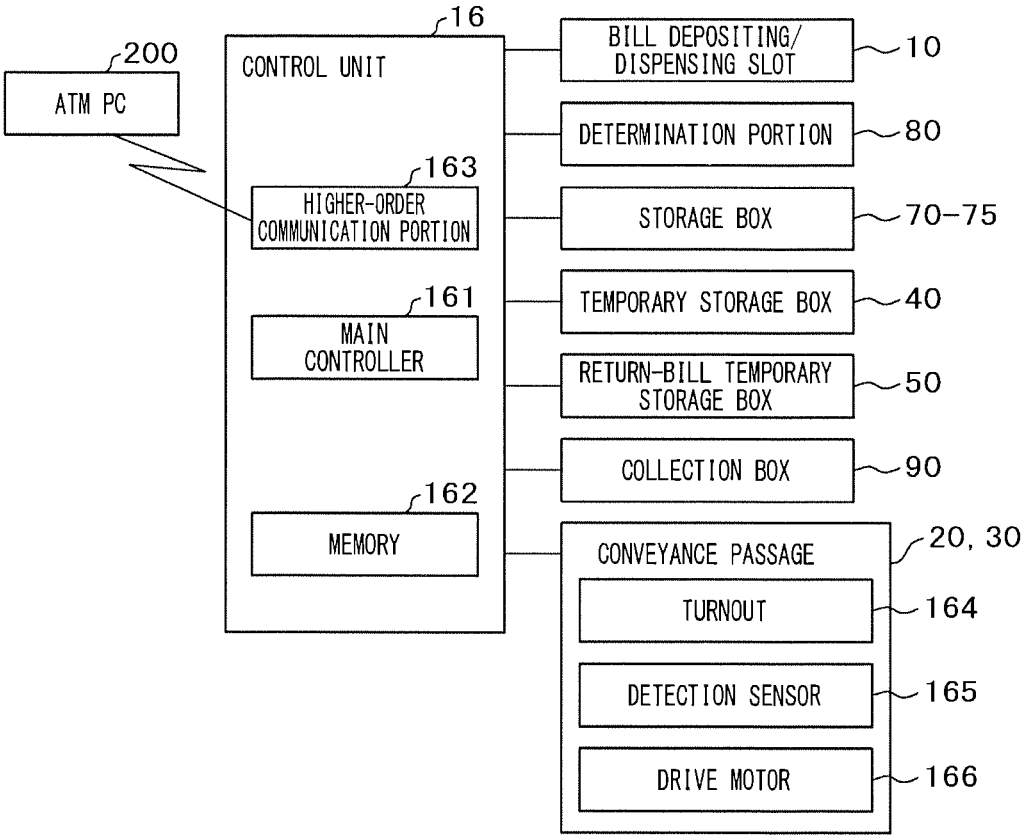
FIG. 4 is a block diagram showing control relations of a bill handling device.

FIG. 4 shows control blocks of the bill handling device 1. The bill handling device 1 includes a control unit 16 not shown in FIG. 1. The control unit 16 includes: a main controller 161; a memory 162; and a higher-order communication portion 163. Using the memory 162, the main controller 161 controls the operations of the above-described components shown in FIG. 1 or acquires information pieces (such as the number of stored bills) sent form sensors of the components. The main controller 161 communicates with an ATMPC 200 as an external device via the higher-order communication portion 163. The conveyance passages 20, 30 include a plurality of turnouts G1 to G11, detection sensors 165 and drive motors 166 (the details of which will be described hereinlater). The conveyance passage 30 is a generic term of conveyance passages 30*a* to 301, the details of which will be described hereinlater. A turnout 164 (hereinafter, referred to as G1 to G11, G20, G30) is disposed at a branching point so as to decide to which of the branch destinations the bill is conveyed. The turnout is operated by an electromagnetic solenoid or the like. The detection sensor 165 outputs detection signals related to bill passage and conveyance abnormality. The drive motor 166 rotates to convey the bill.

Figure 5A:
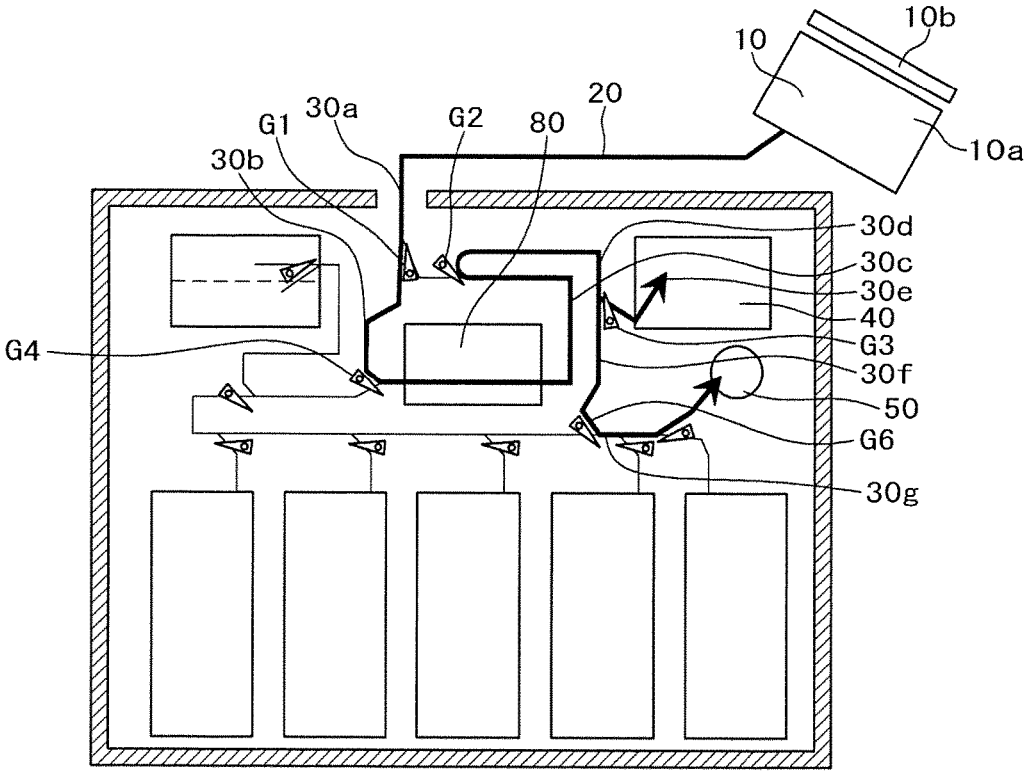
FIG. 5A is a side view showing an operation mode of the bill handling device when the bill is deposited.
Figure 5B:
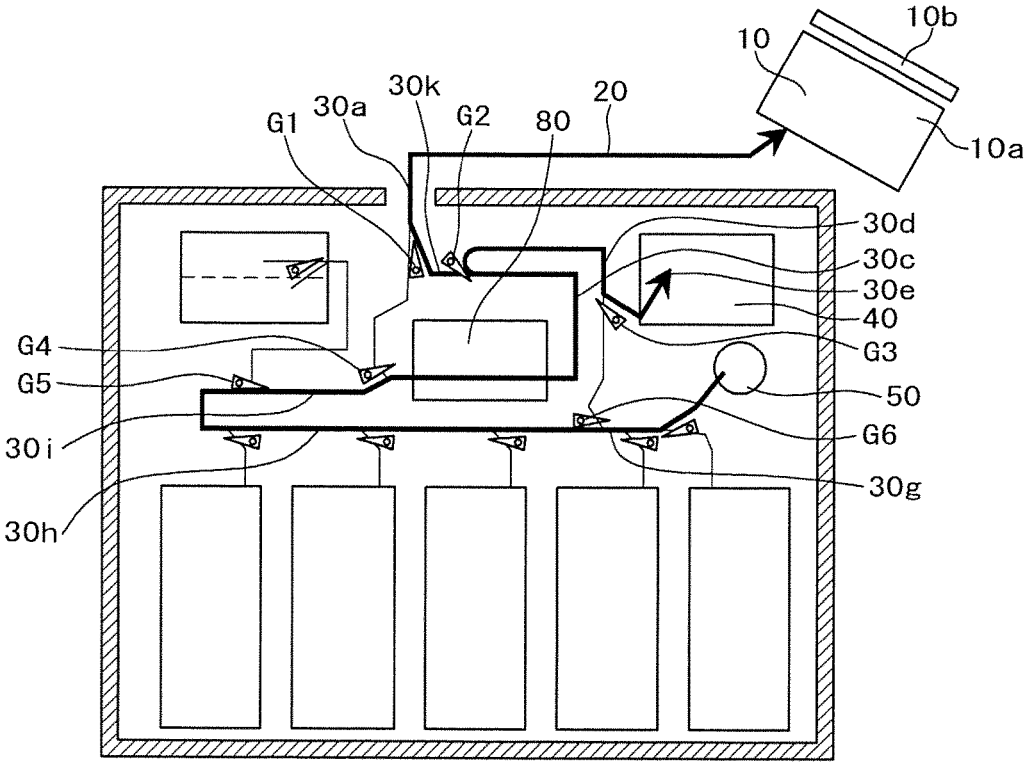
FIG. 5B is a side view showing the operation mode of the bill handling device when the bill is deposited.

FIG. 5A and FIG. 5B are diagrams illustrating a received bill counting process performed by the bill handling device 1. The received bill counting process includes authenticity determination, denomination determination, and counting of bills thrown into the pocket 10*a* of the bill depositing/dispensing slot 10. Starting a received bill dealing process, the control unit 16 delivers the bills in the pocket 10*a* one by one into the conveyance passage 30 via the conveyance passage 20. On the other hand, the control unit 16 connects a conveyance passage 30*a* with a conveyance passage 30*b* by means of the turnout G1 in order to transfer the bill to the conveyance passage 30*b* and then, connects the conveyance passage 30*b* with the determination portion 80 by means of the turnout G4. When the bill arrives at the determination portion 80, the determination portion 80 acquires an image of the bill by means of a sensor mounted in the determination portion 80 so as to determine the authenticity, the denomination and an intact condition (damaged condition) of the bill. When the bill passes through the determination portion 80, the control unit 16 conveys the bill via a conveyance passage 30*c*. The determination by the determination portion 80 is completed while the bill is conveyed through this conveyance passage. After the determination completion, the control unit 16 switches a turnout G3 according to the determination result. Specifically, if the bill is determined to be acceptable, the control unit 16 connects a conveyance passage 30*d* with a conveyance passage 30*e* by means of the turnout G3. As a result, the bill is temporarily stored in the temporary storage box 40. On the other hand, if the bill is determined to be unacceptable, the control unit 16 connects the conveyance passage 30*d* with a conveyance passage 30*f* by means of the turnout G3 and connects the conveyance passage 30*f* with a conveyance passage 30*g* via a turnout G6. Consequently, the bill passes through the conveyance passage 30*g* to be stored in the return-bill temporary storage box 50. If the bill is stored in the return-bill temporary storage box 50, the control unit 16 discharges all the bills placed in the pocket 10*a* and thereafter, return the bill in question to the determination portion 80 by means of turnouts G6, G5, G4 and conveyance passages 30*g*, 30*h*, 30*i*, as shown in FIG. 5B. Accordingly, the bill in question is judged again by the determination portion 80. When the bill in question is determined to be acceptable by the follow-up determination, the control unit 16 stores the bill in the temporary storage box 40, as described above. On the other hand, the control unit 16 returns the bill determined again to be unacceptable to the bill depositing/dispensing slot 10 by means of the turnouts G1, G2 and the conveyance passages 30K 30*a*. In this manner, the risk of accidentally returning the acceptable bill is reduced by reloading the image of the bill once determined to be unacceptable. When all the bills thrown in through the bill depositing/dispensing slot 10 are processed in this manner, the control unit 16 displays the total monetary amount of the bills stored in the temporary storage box 40 by means of an indicator. When the user inputs information indicating that the total monetary amount displayed agrees with the total monetary amount of the thrown-in bills, the control unit 16 stores the bills temporarily stored in the temporary storage box 40 in the storage boxes 71 to 75 to be described as below (received bill storage process).

Figure 6:
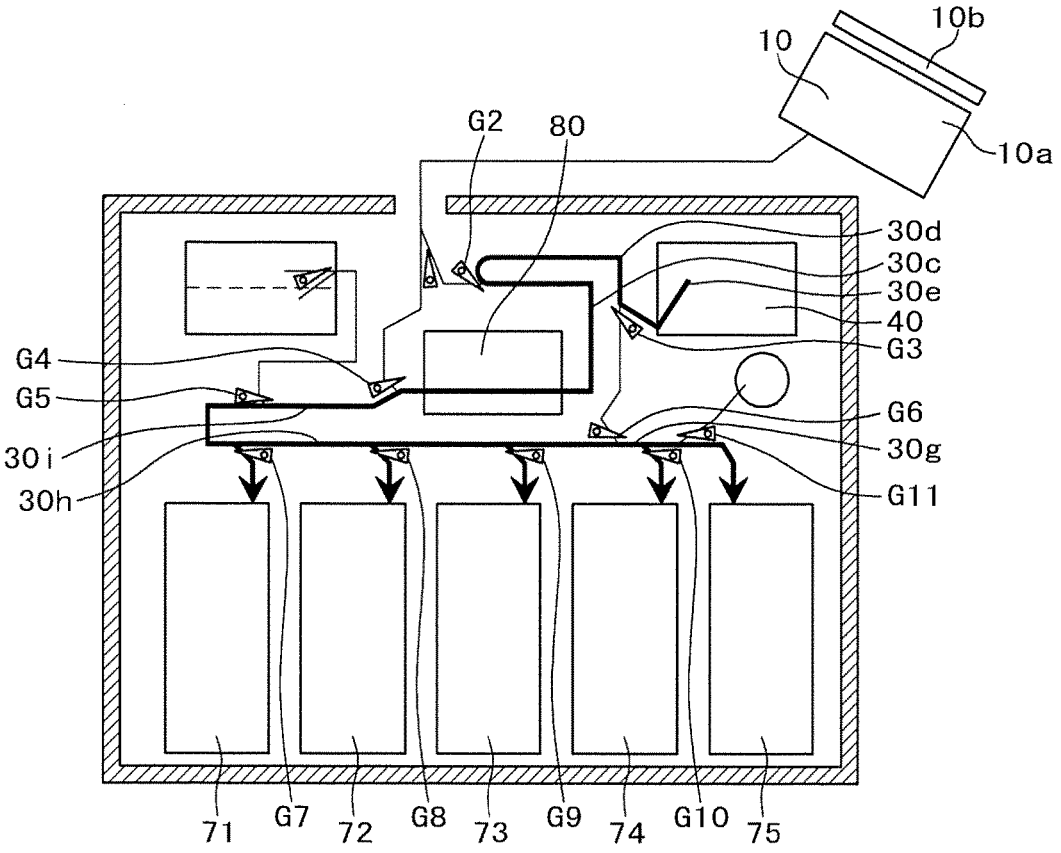
FIG. 6 is a side view showing the operation mode of the bill handling device when the bill is deposited.

The received bill storage process is described with reference to FIG. 6. Starting the received bill storage process, the control unit 16 conveys the bill to a lower part by means of the turnouts G3, G2, G4, G5 and the conveyance passages 30*e*, 30*c*, 30*i*, 30*h*. According to the bill denomination determined by the determination portion 80, the control unit 16 selectively delivers the bill to any one of the storage boxes 71 to 75 as the bill destination by using any one of the turnouts G7 to G11.

Figure 7:
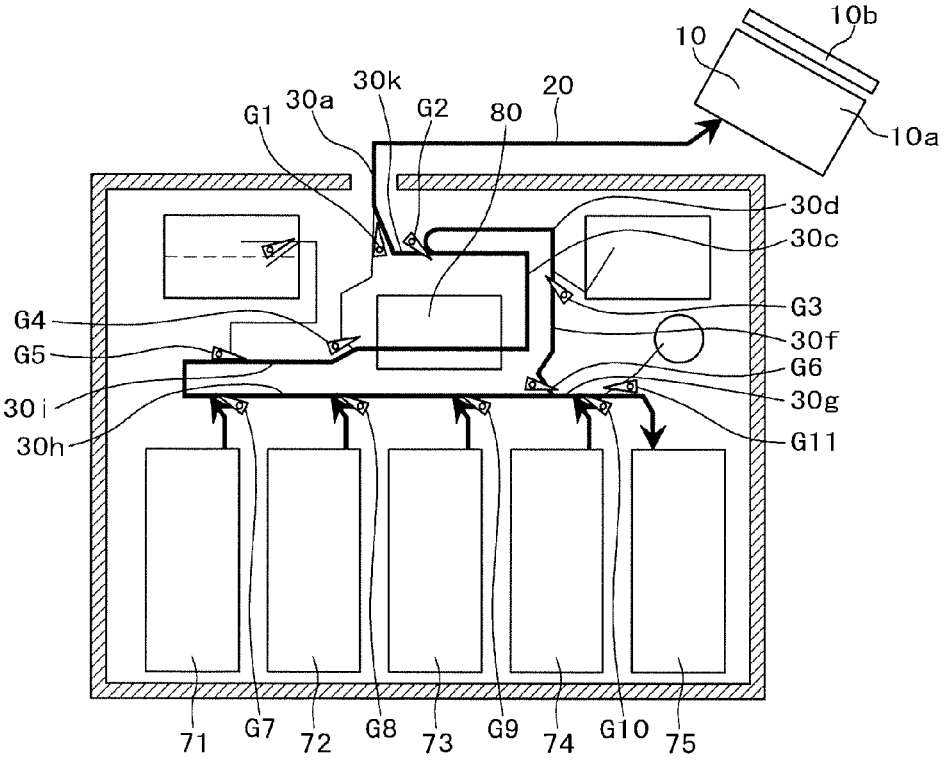
FIG. 7 is a side view showing an operation mode of the bill handling device when the bill is dispensed.

FIG. 7 is a diagram illustrating a dispensed bill dealing process performed by the bill handling device 1. Starting the dispensed bill dealing process, the control unit 16 discharges the bills one by one from the storage boxes 71 to 74 which store the bills by bill denomination. Subsequently, the control unit 16 delivers the discharged bill to the determination portion 80 via the conveyance passages 30*h*, 30*i*. The determination portion 80 determines whether the delivered bill is dispensable or not. If the bill is determined to be dispensable, the control unit 16 connects the conveyance passage 30*c* with the conveyance passage 30*k* by means of the turnout G2. Subsequently, the control unit 16 conveys the bill to the pocket 10*a* by means of the conveyance passage 30*a* and the conveyance passage 20. If the bill is determined to be not dispensable, on the other hand, the control unit 16 connects the conveyance passage 30*c* with the conveyance passage 30*d* by means of the turnout G2. Subsequently, the control unit 16 conveys the bill via the conveyance passages 30*f*, 30*g* so as to store the bill in the storage box 75. The determination of the bill at the time of bill dispensation and the switching of the turnout G2 based on the determination result are completed before the bill arrives at the turnout G2. After all the bills to be dispensed are delivered to the pocket 10*a*, the control unit 16 opens the shutter 10*b*. When the user takes away the bills placed in the pocket 10*a*, the control unit 16 closes the shutter 10*b*, thus completing the dispensed bill dealing process.

Figure 8:
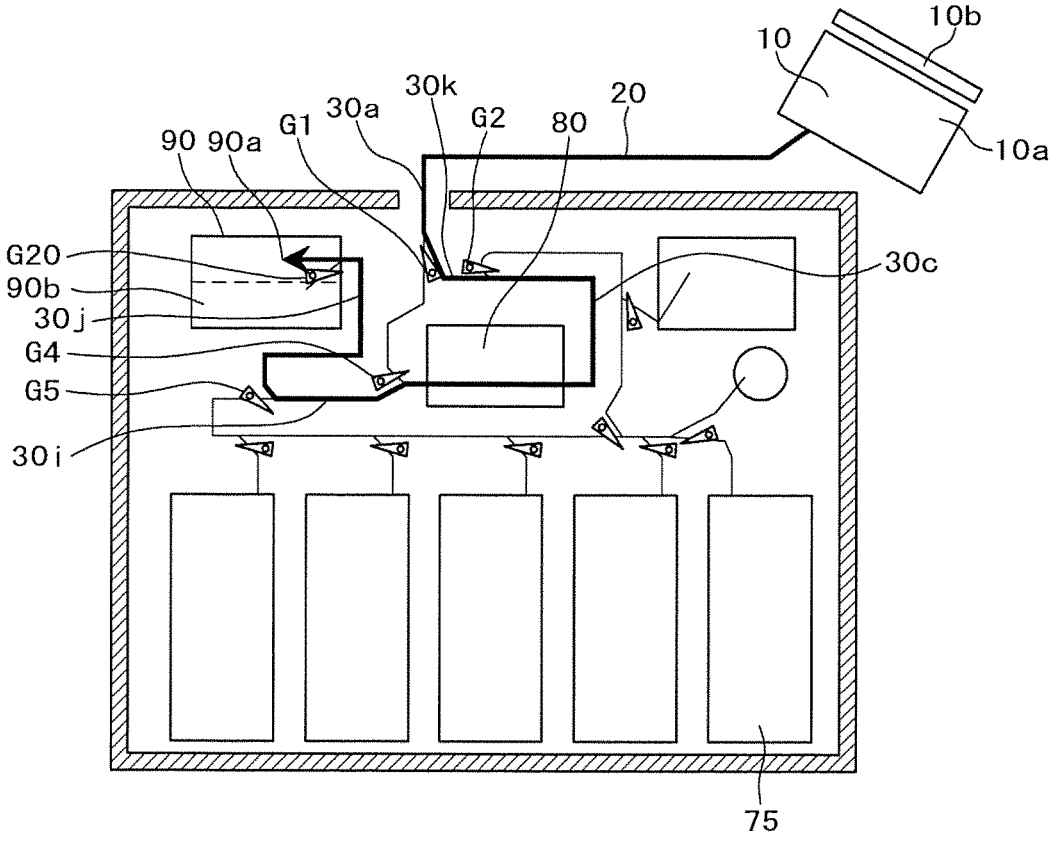
FIG. 8 is a side view showing an operation mode of the bill handling device when a left bill is collected.

FIG. 8 is a diagram illustrating a left bill collection process performed by the bill handling device 1. The collection process is a process provided in case that the user leaves bill(s) dispensed in the pocket 10*a* by the dispensed bill dealing process. The process is for collecting the left bill(s) in the collection box 90 (otherwise, the storage box 74 or the storage box 75). In a case where the bills are left in the pocket 10*a* for a predetermined length of time, the control unit 16 transfers the left bills one by one from the pocket 10*a* to the conveyance passage 20. Subsequently, the control unit 16 stores the bills in an upper storage box 90*a* of the storage box 90 by means of the conveyance passages 30*a*, 30*k*, 30*c*, 30*i*, 30*j* and the turnout G20, thus completing the collection process.

Figure 9:
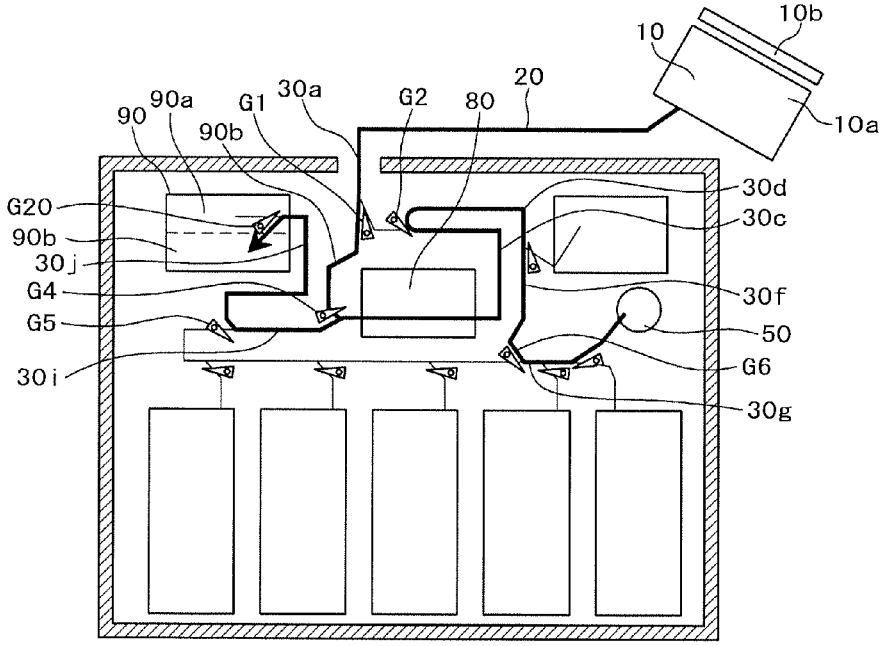
FIG. 9 is a side view showing an operation mode of the bill handling device when a bogus bill is collected.

Next, description is made on an exemplary operation performed in a case where the determination portion 80 detects some bogus bill in the received bill counting process. This operation is performed in order to store the bogus bill detected in the received bill dealing process at a place different from places where the other bills are stored. When the determination portion 80 detects the bogus bill in the received bill dealing process, the control unit 16 temporarily stores the bogus bill in the return-bill temporary storage box 50 along with bills to be returned for other reasons. This storage operation is performed using a reel, tape, wheel, roller and the like disposed at the return-bill temporary storage box 50. The control unit 16 transfers bills one by one into the return-bill temporary storage box 50 by using these components, and also stores the ordinal number of the bogus bill in the memory 162. When all the bills placed in the pocket 10*a* are judged one by one by the determination portion 80, the control unit 16 discharges the bills one by one from the return-bill temporary storage box 50 (FIG. 9). When a bill determined to be the bogus bill is discharged, the control unit 16 delivers the bill to a lower storage box 90*b* of the collection box 90 by means of the conveyance passages 30*g*, 30*f*, 30*d*, 30*c* and the turnout G20. Further, the control unit 16 also transfers a bill, which is determined by the determination portion 80 to be returned for some other reason, to the pocket 10*a* by means of the conveyance passages 30*b*, 30*a*.

Figure 10:
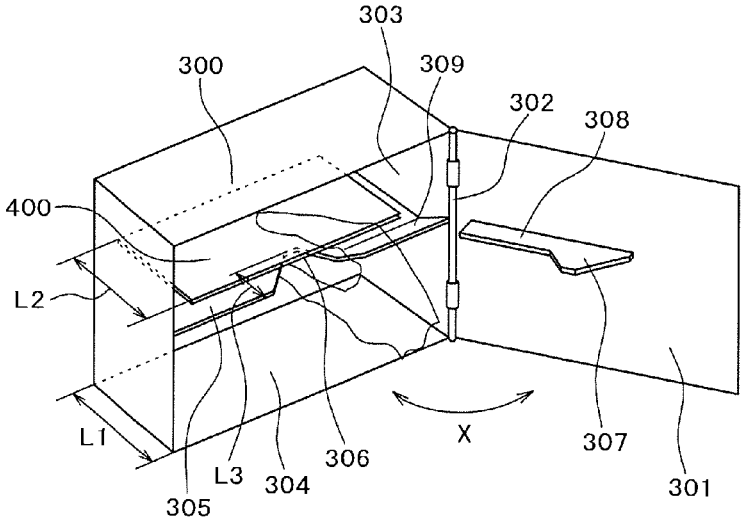
FIG. 10 is a perspective view of a bill storage box according to the invention.
Figure 11:
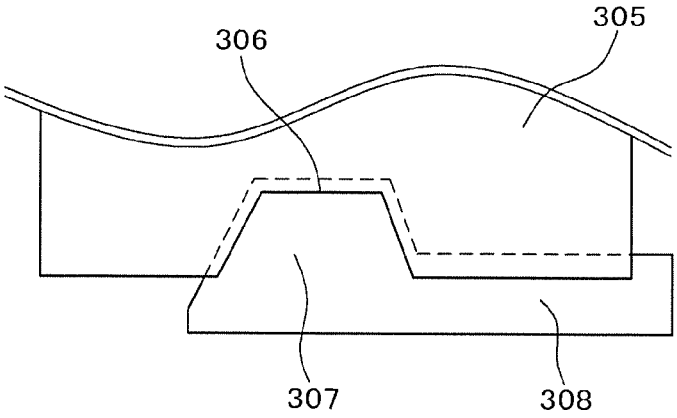
FIG. 11 is a top plan view showing a relation between a partition plate and a lid protrusion according to the invention.
Figure 12A:
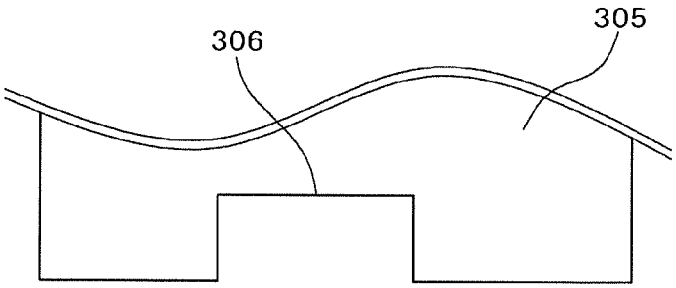
FIG. 12A is a diagram showing a configuration according to another embodiment of the invention.
Figure 12B:
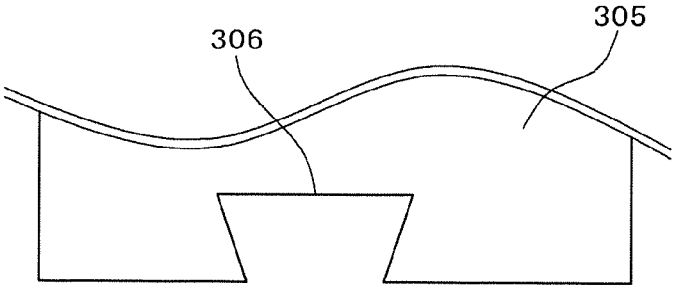
FIG. 12B is a diagram showing a configuration according to another embodiment of the invention.
Figure 12C:
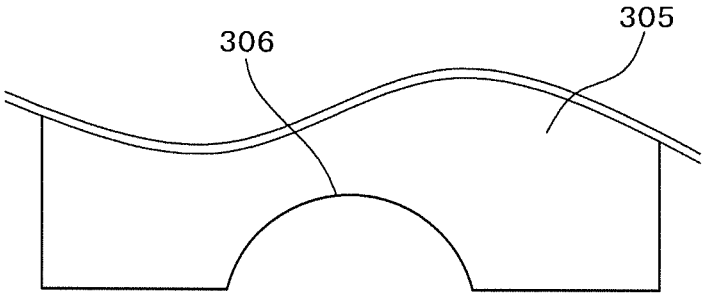
FIG. 12C is a diagram showing a configuration according to another embodiment of the invention.
Figure 12D:
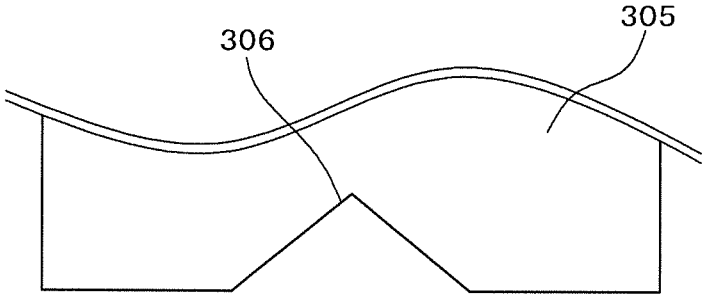
FIG. 12D is a diagram showing a configuration according to another embodiment of the invention.

A detailed description is made as below on the collection box 90 with reference to FIG. 10 and FIG. 11. FIG. 10 is a perspective view of the collection box 90 with its lid opened. FIG. 11 is a top plan view of the collection box 90 with its lid closed, showing a relation of a partition plate 305, a recess 306 and protrusions 307, 308 to be described hereinlater.

The collection box 90 includes a main body 300 and a lid 301. The lid 301 has a door-like configuration such that the lid pivotally opens/closes in a direction of the arrow X about a support 302 as a pivot shaft disposed in parallel to a bill stacking direction. The lid opens and closes an opening of a storage space constituting the collection box 90. The storage space in the collection box 90 is divided by the partition plate 305 into an upper storage portion 303 and a lower storage portion 304. The partition plate 305 includes the recess 306 which is widened toward the above-described opening or toward the lid 301. A depth length L1 of the collection box 90 is slightly longer than a size L2 of the largest bill handled, while the recess 306 has such a length L2 as to overlap with the bill. When extracting the bills from the collection box 90, a collector normally holds a central part of the bills. Therefore, the partition plate 305 shown in FIG. 10 is formed with the recess 306 at the central part of the partition plate 305. However, the recess need not necessarily be formed at the central part of the partition plate so long as the recess corresponds to a bill extraction position.

The lid 301 is provided with the protrusion 307 which is tapered toward the above-described opening or in a direction away from the lid 301. Specifically, the protrusion 307 is perpendicular to a surface of the lid 301 and is progressively decreased in width in the depth direction of the collection box 90 as seen when the lid 301 is closed. Further, as shown in FIG. 11, the protrusion 307 is configured to be slightly larger than the recess 306 so that there is no clearance between the protrusion and the recess when the lid 301 is closed. The protrusion 307 is continuous with the protrusion 308. The protrusion 308 protrudes from the lid 301 in the same direction as the protrusion 307. More specifically, the protrusion 308 is formed on the opening side of the lid and between the protrusion 307 and the support 302 of the lid in continuous relation with the protrusion 307. When the lid 301 is closed, the protrusion 308 is moved to a predetermined position as guided by an inclined guide portion 309 formed at the partition plate 305 on the lid-301 side thereof (In the figure, the protrusions 307, 308 are moved into positions under the guide portion 309 and the recess 306).

The guide portion 309 formed at the partition plate 305 is inclined toward the upper storage portion 303 relative to a partition plane so that a lid-301 side end of the guide portion 309 has a greater height from a bottom of the collection box 90 than that of the protrusion 308. Therefore, when the lid 301 starts to be closed, the protrusion 308 is progressively moved from the support 302 side toward an underside of the guide portion 309 so that the protrusion 307 is moved into position under the recess 306 when the lid 301 is fully closed. In other words, the protrusion 308 guides the lid 301 pivotally closing about the support 302 by being moved into position under the guide portion 309 or on the opposite thereof from an inclination surface thereof.

In a case where bills 400 are stored in the upper storage portion 303 with the lid 301 closed, the recess 306 of the partition plate 305 is closed with the protrusion 307 of the lid 301. Therefore, even if a bill 400 is rejected as folded or crumpled and stored, the bill 400 will not accidentally enter the lower storage box 304 because there is no clearance to allow an end of the bill to enter the lower storage box. When the stored bills 400 are extracted, the bills can be extracted by opening the lid 301, followed by inserting fingers in the recess 306 for picking up the bills. Hence, the bill extraction handleability is not impaired by the partition plate 305 interfering with the bill extraction operation.

According to the embodiment, the partition plate partitioning the storage space is formed with the recess while the lid is provided with the protrusion. This not only ensures the easy bill extraction operation to extract the bills from the storage space but also prevents the bills from being moved and dropped in another partitioned space in the storage space. Further, the embodiment is adapted to guide the protrusion into the predetermined position when the open lid is closed. This ensures that the lid is reliably closed even when a rough handling displaces the protrusion relative to the partition plate. Thus, the embodiment can achieve an improvement in breakage resistance. As shown in FIG. 12A to FIG. 12D, the recess 306 formed in the partition plate 305 according to another embodiment may have a rectangular shape, circular shape, inverted trapezoidal shape or the like.

As described above, when the bills are stored in the upper storage portion, the recess of the partition plate is closed with the protrusion of the lid. Even if a bill is rejected as folded or crumpled, the bill will not accidentally enter the lower storage box because there is no clearance to allow an end of the rejected bill to enter the lower storage box. Thus is provided a paper sheet storage box having high reliability. The recess is configured to widen toward the lid side and to be always overlapped with the bill. The box is adapted for easy insertion of a hand to extract the bills. Thus, the embodiment can provide the paper sheet storage box featuring excellent handleability. When the open lid is closed, the lid is closed with the protrusion returned to the bill extraction position as guided by the inclined guide portion formed at the partition plate. If the rough handling should displace the protrusion relative to the partition plate, the protrusion can be reliably guided into the predetermined position for engagement. The embodiment can provide the paper sheet storage box having high reliability. Further, the paper sheet storage box can be reduced in size by forming the storage box in substantially the same size as that of the bill.

The above embodiments have been described by way of the case where the paper sheet storage box according to the invention is applied to the collection box. However, the invention may also be applied to other storage boxes such as the temporary storage box 40, the return-bill temporary storage box 50, the storage boxes 71 to 75 and the like which have the same functions as this collection box, so as to implement the above-described processes including the received bill counting process, the received bill storage process, the dispensed bill dealing process, the left bill collection process and the like.

REFERENCE SIGNS LIST

1: bill handling device,
10: bill depositing/dispensing slot,
10*a*: pocket,
10*b*: shutter,
16: control unit,
20: conveyance passage,
21: bill slot,
30*a*-1: conveyance passage,
40: temporary storage box,
50: return-bill temporary storage box,
71 to 75: storage box,
80: determination portion,
90: collection box,
90*a*: upper storage box,
90*b*: lower storage box,
91: loading collection box,
161: main controller,
162: memory,
163: higher-order communication portion,
164: turnout,
165: detection sensor,
166: drive motor,
101: automatic teller machine,
101*a*: upper front panel,
101*b*: machine housing,
101*e*: power supply
102: card statement processing mechanism,
102*a*: card slot,
105: customer operation portion,
106*a*: vault door,
107: main body controller,
107*a*: bus,
107*b*: interface,
107*d*: external storage,
200: ATMPC,
A: vault,
G1 to 11, G20, G30: turnout,
300: main body,
301: lid,
302: support,
303: upper storage portion,
304: lower storage portion,
305: partition plate,
306: recess,
307, 308: protrusion,
309: guide portion,
400: bill.

The invention claimed is:

1. A paper sheet storage box comprising:

a partition member which partitions a paper sheet storage space into a plurality of storage spaces and includes a recess at a position for extraction of paper sheets; and a door which includes a protrusion located at a position on the door corresponding to the recess of the partition member so as to close the recess when the door is closed, and which serves to open or close an opening of the paper sheet storage space including the plurality of storage spaces.

2. The paper sheet storage box according to claim 1, wherein the recess is configured to widen toward the opening while the protrusion is configured to taper toward the opening.

3. The paper sheet storage box according to claim 1, wherein the door pivotally opens or closes around a pivot shaft which is positioned in parallel to a stacking direction of the paper sheets, the door including a second protrusion which protrudes from the door in a same direction as the protrusion and is in a continuous relation with the protrusion, the second protrusion located between the protrusion and the pivot shaft, the partition member includes a guide portion, an opening-side end of which is inclined relative to a partition plane, and the second protrusion guides the door pivotally closing around the pivot shaft by moving into a position on an opposite side of the guide portion from the inclination thereof.

4. The paper sheet storage box according to claim 1, wherein the protrusion is configured to be larger than the recess.

5. An automatic teller machine comprising the paper sheet storage box according to claim 1.

* * * * *